US007410160B2

(12) United States Patent
Jeon

(10) Patent No.: US 7,410,160 B2
(45) Date of Patent: Aug. 12, 2008

(54) PICK-UP UNIT AND AN IMAGE FORMING APPARATUS HAVING THE SAME

(75) Inventor: Nam-gon Jeon, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 378 days.

(21) Appl. No.: 11/211,580

(22) Filed: Aug. 26, 2005

(65) Prior Publication Data

US 2006/0071397 A1 Apr. 6, 2006

(30) Foreign Application Priority Data

Sep. 6, 2004 (KR) ..... 10-2004-0070962

(51) Int. Cl.
*B65H 3/06* (2006.01)
*B65H 3/32* (2006.01)

(52) U.S. Cl. ..... 271/119; 271/113; 271/117; 271/120

(58) Field of Classification Search ..... 271/117, 271/119, 113, 114, 264, 314; 403/3, 4
See application file for complete search history.

(56) References Cited

U.S. PATENT DOCUMENTS 4,084,807 A 4/1978 Terjima et al.
4,796,878 A * 1/1989 Nichelson et al. ..... 271/10.16
4,858,907 A * 8/1989 Eisner et al. ..... 271/124
5,326,184 A * 7/1994 Shibata ..... 400/624
5,630,583 A * 5/1997 Yergenson ..... 271/119
5,639,583 A * 6/1997 Takeuchi et al. ..... 430/47.5
5,739,458 A * 4/1998 Girard ..... 89/36.02
6,179,495 B1 * 1/2001 Sugata et al. ..... 396/612
2003/0209852 A1 * 11/2003 Choi ..... 271/291

FOREIGN PATENT DOCUMENTS

JP 60-190749 12/1985
JP 2-145245 10/1990
JP 08-091598 4/1996
JP 2002-226066 8/2002

* cited by examiner

*Primary Examiner*—David Bollinger
*Assistant Examiner*—Luis A Gonzalez
(74) *Attorney, Agent, or Firm*—Roylance, Abrams, Berdo & Goodman, L.L.P.

(57) ABSTRACT

A paper pick-up unit of an image forming apparatus includes an elliptical pick-up rubber having a first arcuate part and a second arcuate part. The first and second arcuate parts are symmetrical to each other and contact a paper. A pick-up housing supports the pick-up rubber, which are attached around the circumference thereof. A first shaft opening and a second shaft opening are formed opposite to each other in the pick-up housing and are eccentrically disposed with respect to a center of the pick-up housing. A pick-up shaft is engaged with one of the first shaft opening and the second shaft opening of the pick-up housing, and is capable of rotating. The pick-up shaft is engaged with the first shaft opening of the pick-up housing for the first arcuate part of the pick-up rubber to pick up a paper. The pick-up shaft is engaged with the second shaft opening of the pick-up housing for the second arcuate part of the pick-up rubber to pick up a paper.

20 Claims, 7 Drawing Sheets

PICK-UP UNIT AND AN IMAGE FORMING APPARATUS HAVING THE SAME

CROSS-REFERENCE TO RELATED APPLICATIONS

This application claims the benefit under 35 U.S.C. § 119 (a) of Korean Patent Application No. 2004-70962 filed on Sep. 6, 2004, the entire disclosure of which is hereby incorporated by reference.

BACKGROUND OF THE INVENTION

1. Field of the Invention

The present invention relates to an image forming apparatus, such as a printer, a multi-function peripheral device, and a facsimile. More particularly, the present relates to an improved paper pick-up unit and an image forming apparatus having the same.

2. Description of the Related Art

As is well known, a paper pick-up unit of an image forming apparatus picks up the uppermost sheet of paper from a plurality of papers stacked in a feeding cassette to feed it on a paper transmission path. FIG. 1 is a view of an example of a typical paper pick-up unit.

In FIG. 1, the reference numerals 100 and 110 denote a feeding cassette and a paper pick-up unit, respectively. Referring to FIG. 1, the paper pick-up unit 110 includes a pick-up rubber 111 contacting a paper P, and a pick-up housing 113 supporting the pick-up rubber 111. A pick-up shaft 115 penetrates through the pick-up housing 113 and is rotated by a driving device (not shown). A pick-up idler 117 engages the pick-up shaft 115 and is located at both ends of the pick-up housing 113.

In the above paper pick-up unit, an arc portion 111*a* of the pick-up rubber 111 frictionally contacts the paper P to pick up the paper P. Because the diameter of the pick-up idler 117 is smaller than the diameter of the arc portion 111*a* of the pick-up rubber 111, only the arc portion 111*a* of the pick-up rubber 111 contacts the paper P during rotation of the pick-up rubber 111. The pick-up idler 117 operates to regularly keep contact between the paper P and the pick-up rubber 111.

As described above, because only the arc portion 111*a* of the pick-up rubber 111 frictionally contacts the paper P, the arc portion 111*a* is abraded by the paper P or damaged by paper powders. As such, the coefficient of friction decreases with the passage of time, and the pick-up rubber may not function properly.

The pick-up rubber 111 has a predetermined life span, and can be averagely used for approximately fifty thousand to sixty thousand sheets of paper P. The image forming apparatus can be averagely used for more than approximately one hundred thousand sheets of paper P. In other words, the average life span of the image forming apparatus is relatively longer than that of the pick-up rubber 111. As such, if the arc portion 111*a* of the pick-up rubber 111 is abraded and the life span is terminated, the pick-up rubber 111 or the whole paper pick-up unit 110 needs to be replaced. To replace the conventional paper pick-up unit, a user needs the help of a specialist due to the complex construction of the paper pick-up unit. In other words, the conventional paper pick-up unit burdens the user in time and economy.

Accordingly, a need exists for an image forming apparatus having an improved paper pick-up unit with a longer lifespan.

SUMMARY OF THE INVENTION

An object of the present invention is to provide a paper pick-up unit of which life span may be doubled by changing the position of one pick-up rubber to reuse, and in which the position of the pick-up rubber may be easily changed by a user of an image forming apparatus, and an image forming apparatus having the same.

A paper pick-up unit of an image forming apparatus includes an elliptical pick-up rubber having a first arcuate part and a second arcuate part. The first and second arcuate parts are symmetrical to each other and are adapted to contact a paper. A pick-up housing supports the pick-up rubber attached around a circumference thereof. A first shaft opening and a second shaft opening are formed opposite to each other and eccentrically with respect to a center of the pick-up housing. A pick-up shaft engages one of the first shaft opening and the second shaft opening of the pick-up housing, and is capable of rotating.

The pick-up shaft may be engaged with the first shaft opening of the pick-up housing for the first arcuate part of the pick-up rubber to pick up a paper, and the pick-up shaft is engaged with the second shaft opening of the pick-up housing for the second arcuate part of the pick-up rubber to pick up a paper.

If one arcuate part is used up, the other arcuate part may be used, and as such, the life span of the pick-up rubber may be doubled.

The paper pick-up unit may further include a pick-up idler engaged with the pick-up shaft for maintaining regular contact between the first arcuate part or the second arcuate part and the paper.

Two idlers may be used to engage the pick-up shaft and to distance from the opposite sides of the pick-up housing.

The pick-up housing may include a connecting opening to connect the first shaft opening and the second shaft opening and to easily change the position of the pick-up shaft. A lock means locks the pick-up shaft when the pick-up shaft changes the position from the first shaft opening to the second shaft opening or vice versa.

The pick-up shaft locking means may include locking protrusions each protruding inward from both ends of a mouth part of the first shaft opening and the second shaft opening, respectively.

The pick-up shaft locking means may include key grooves formed at the mouth part of the first shaft opening and the second shaft opening and a key engaged with the key grooves.

The first shaft opening and the second shaft opening may be quadrangle, and the pick-up shaft may have a flattened U shape cross section.

An image forming apparatus includes an image forming unit having a photoconductive medium for forming an electrostatic latent image, and a development unit for developing the electrostatic latent image of the photoconductive medium. A transmission unit having a paper transmission path connects the image forming unit with a paper feeding cassette stacking a plurality of papers therein. A paper pick-up unit picks up a sheet of paper stacked in the paper feeding cassette to enter the paper to the paper transmission path. The paper pick-up unit includes an elliptical pick-up rubber having a first arcuate part and a second arcuate part. The first and second arcuate parts are symmetrical to each other and contact a paper. A pick-up housing supports the pick-up rubber attached around the circumference thereof, and has a first shaft opening and a second shaft opening that are formed oppositely to each other and eccentrically with respect to a center of the pick-up housing. A pick-up shaft engages with one of the first shaft opening and the second shaft opening of the pick-up housing, and is capable of rotating.

According to the present invention, the life span of the pick-up rubber may be doubled, and the arcuate parts of the pick-up rubber may be easily replaced by a user. As such, the cost may be decreased and the convenience for use may be increased.

Accordingly, a need exists for an image forming apparatus having an automatic document feeder that controls the speed of a document passing therethrough to improved the quality of copied and scanned images.

BRIEF DESCRIPTION OF THE DRAWINGS

The above and other aspects, features and advantages of the present invention will be more apparent from the following detailed description taken with reference to the accompanying drawings, in which.

Throughout the drawings, like reference numerals will be understood to refer to like parts, components and structures.

DETAILED DESCRIPTION OF EXEMPLARY EMBODIMENTS

Certain embodiments of the present invention will be described in greater detail with reference to the accompanying drawings.

The matters defined in the description, such as a detailed construction and elements thereof, are provided to assist in a comprehensive understanding of the invention. Thus, it is apparent that the present invention may be carried out without those defined matters. Also, descriptions of well-known functions and constructions are omitted to provide a clear and concise description.

Figure 2:
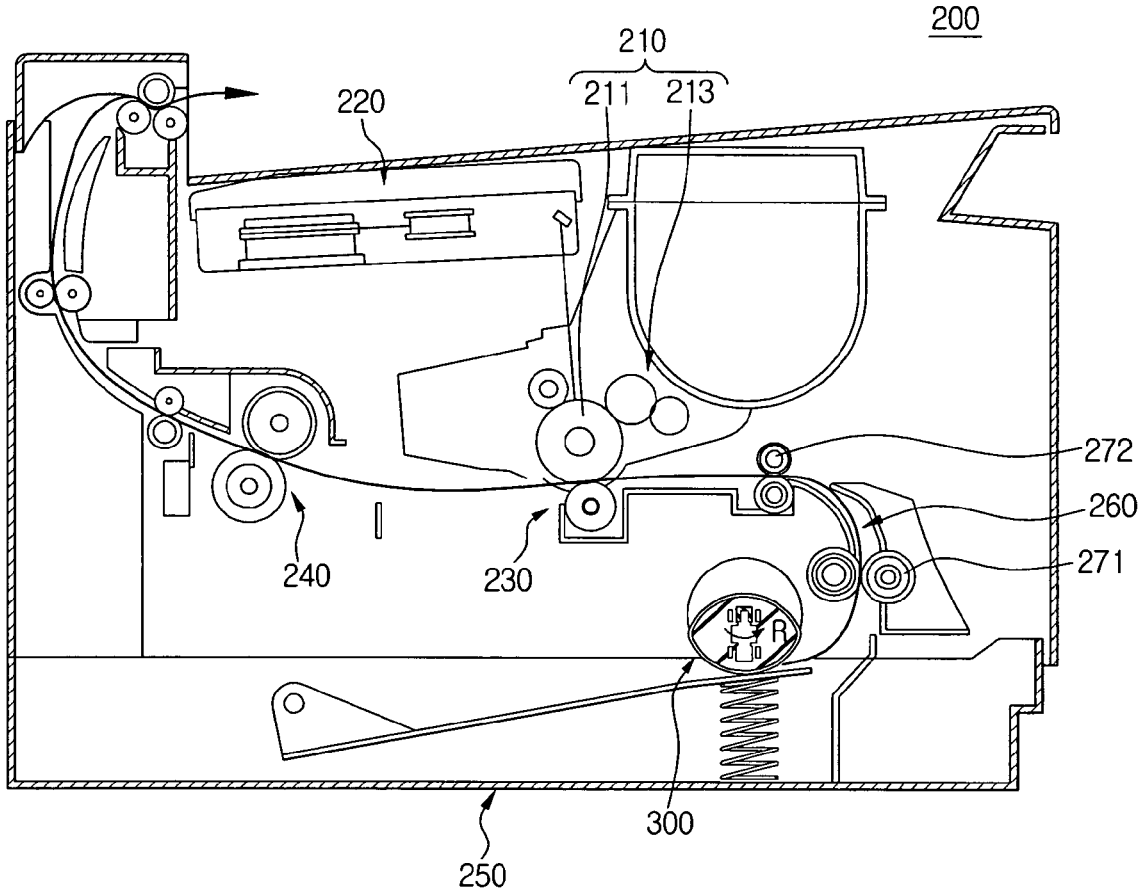
FIG. 2 is a schematic view of an image photographing apparatus applying a paper pick-up unit according to an exemplary embodiment of the present invention.
Figure 3:
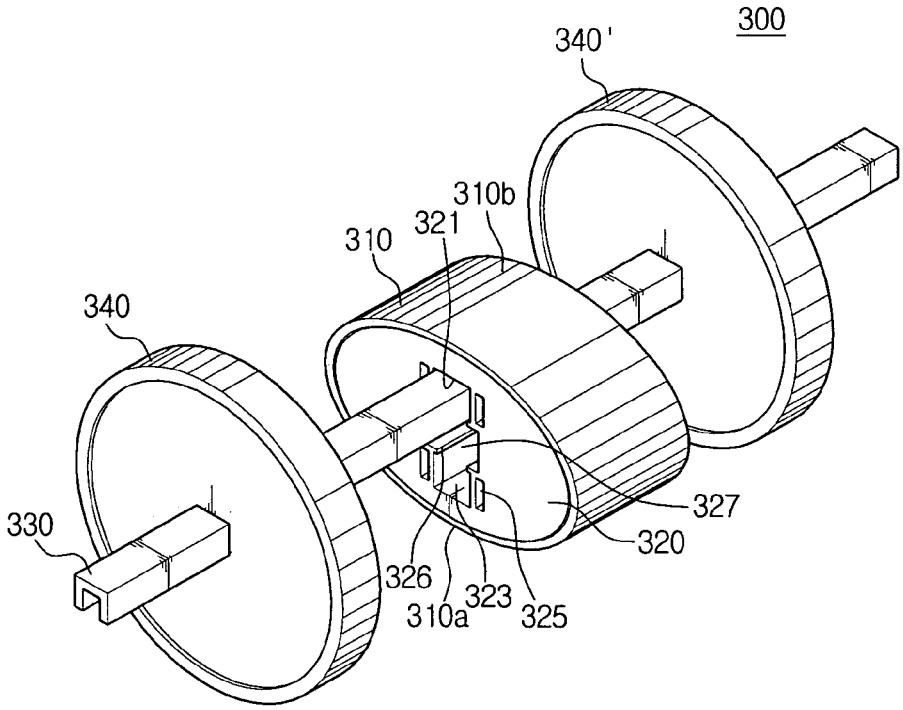
FIG. 3 is a perspective view of the paper pick-up unit of FIG. 2.

FIG. 2 is a schematic view of an image photographing apparatus 200 applying a paper pick-up unit 300 according to an exemplary embodiment of the present invention. FIG. 3 is a perspective view of the paper pick-up unit according to an exemplary embodiment of the present invention.

Referring to FIGS. 2 and 3, an image forming unit 210 includes a photoconductive medium 211 and a development part 213. A laser scan unit 220 emits a laser beam to the photoconductive medium 211 to form an electrostatic latent image. The electrostatic latent image of the photoconductive medium 211 is developed to a visible image with a toner by the development part 213, and the visible image is transferred to a paper P that passes between the photoconductive medium 211 and a transfer roller 230 rotating in contact with the photoconductive medium 211. The paper P is then fed through a fuse unit 240.

The paper P stacked in a paper feeding cassette 250 is picked up sheet-by-sheet by a paper pick-up unit 300 according to an exemplary embodiment of the present invention. The picked-up paper is fed along a paper transmission path 260, and transferred to the image forming unit 210 by a transmission unit having a plurality of transmission rollers 271 and 272.

Figure 4A:
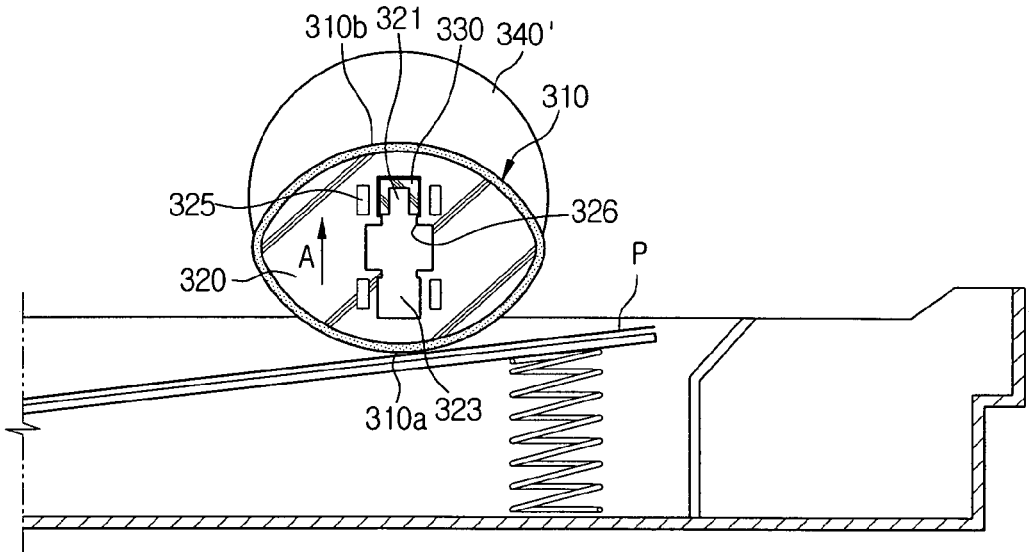
FIG. 4A, FIG. 4B and FIG. 4C are elevational views showing each step of replacing a pick-up rubber of the paper pick-up unit of FIG. 3.

The paper pick-up unit 300 includes a pick-up rubber 310, a pick-up housing 320, a pick-up shaft 330 and pick-up idlers 340 and 340', as shown in FIGS. 3 and 4A.

The pick-up rubber 310 is wrapped around the pick-up housing 320, and directly contacts the paper P. The pick-up rubber 310 is preferably made from Ethylene Propylene Diene Monomer (EPDM) in view of friction with the paper P. The pick-up rubber 310 may be averagely used for approximately fifty thousand to sixty thousand sheets of paper P.

The pick-up housing 320 takes on an elliptical configuration and has a first shaft opening 321 and a second shaft opening 323 to be selectively engaged with the pick-up shaft 330.

The elliptical pick-up housing 320 may be manufactured as follows. First, two circles of substantially the same diameter are partially overlapped with each other, with the center of each circle positioned in the partially overlapped portion. The other portions except for the overlapped portion are removed, and the first shaft opening 321 and the second shaft opening 323 are formed at the center of each circle.

Due to the presence of the pick-up housing 320, only the first arcuate part 310*a* of the pick-up rubber 310 contacts the paper P when the pick-up shaft 330 is rotated in engagement with the first shaft opening 321. The first shaft opening 321 is a center of the first arcuate part 310*a* of the pick-up rubber 310. Alternatively, only the second arcuate part 310*b* of the pick-up rubber 310 contacts the paper P when the pick-up shaft 330 is rotated in engagement with the second shaft opening 323. The second shaft opening 323 is a center of the second arcuate part 310*b* of the pick-up rubber 310.

Figure 1:
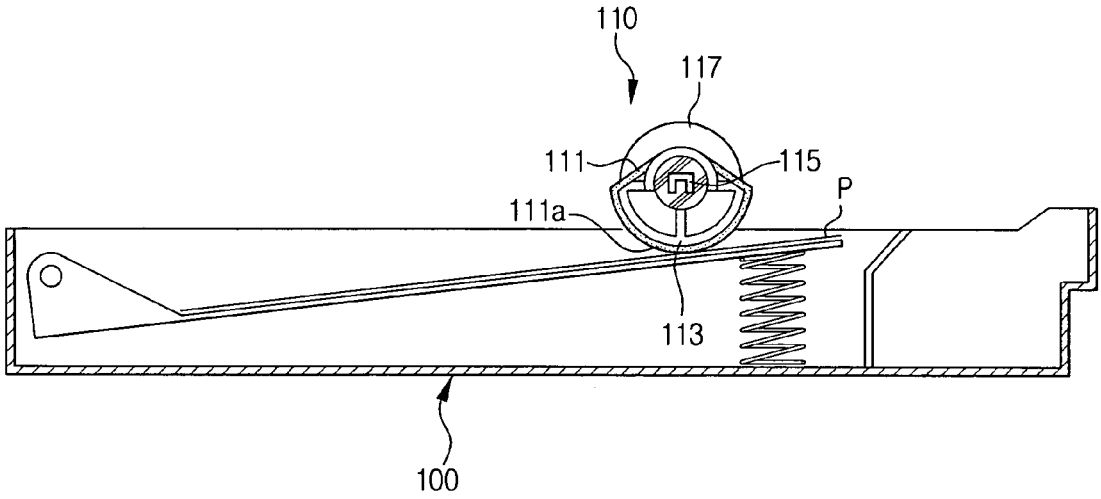
FIG. 1 (PRIOR ART)
FIG. 1 is a schematic view of a conventional paper pick-up unit of an image photographing apparatus.

If the aforementioned structure is applied, the life span of the pick-up rubber 310 becomes twice as long as a pick-up rubber 111 (refer to FIG. 1) of a conventional pick-up unit. This is because the first arcuate part 310*a* and the second arcuate part 310*b* of the pick-up rubber 310 may be used in turn.

Each of the first shaft opening 321 and the second shaft opening 323 is open at one side and connected with each other by a connection opening 327 extended therebetween. Accordingly, a user may more easily use the first arcuate part 310*a* and the second arcuate part 310*b* of the pick-up rubber 310 in turn. A user does not need to separate the pick-up shaft 330 from the pick-up housing 320, but simply moves the pick-up shaft 330 from the first shaft opening 321 of the pick-up housing 320 to the second shaft opening 323, or vice versa along the connection opening 327.

The connecting opening 327 takes on the configuration of a quadrangular opening and is sized for the pick-up shaft 330 to be rotated by an angle of 180 degrees. The pick-up shaft should be rotated by an angle of 180 degrees in the connecting opening 327 to use the first arcuate part 310*a* and the second arcuate part 310*b* of the pick-up rubber 310 in turn, and the detailed description thereof will follow below.

Lock protrusions 326 protrude inwardly from both ends of open side of the first shaft opening 321 and the second shaft opening 323, respectively, to lock the pick-up shaft 330 in its respective opening. When the pick-up shaft 330 is engaged with the first shaft opening 321 or the second shaft opening 323, movement of the pick-up shaft 330 is prevented due to the lock protrusions 326.

The lock protrusions 326 are preferably elastic such that the pick-up shaft 330 may move from the first shaft opening 321 to the second shaft opening 323, or from the second shaft opening 323 to the first shaft opening 321.

For example, if the pick-up shaft 330 engaged with the first shaft opening 321 moves to the connecting opening 327, the pick-up shaft 330 moves over the lock protrusions 326. The lock protrusions 326 are elastic and resilient enough to bend and then recover after the pick-up shaft 330 moves over the lock protrusions 326. As such, the thickness of the lock protrusions 326 is set in view of proper elasticity. Additionally, hollow spaces 325 may be formed on an upper portion and a lower portion of the pick-up housing 320 having the lock protrusions 326, to provide the lock protrusions 326 with more elasticity.

The pick-up shaft 330 is a rotation shaft having a substantially flattened U-shape cross section that receives a driving force from a driving device (not shown) and provides the pick-up rubber 310 with a rotation force to transfer the paper P to the image forming unit 210.

The driving device may include a gear, a clutch and a solenoid. Normally, the pick-up rubber 310 and the pick-up housing 320 do not rotate due to the clutch, and then are rotated once by the operation of the solenoid to pick up the paper P.

The pick-up idlers 340 and 340' are engaged with the pick-up shaft 330 and regulate contact between the pick-up rubber 310 and the paper P. For example, if the pick-up shaft 330 is engaged with the first shaft opening 321 of the pick-up housing 320, only the first arcuate part 310*a* of the pick-up rubber 310 contacts the paper P. Although the pick-up idler 340 and 340' are rotated, the second arcuate part 310*b*, which is the opposite side of the first arcuate part 310*a*, of the pick-up rubber 310 does not contact the paper P because the diameter of the rotation orbit of the second arcuate part 310*b* is smaller than that of the pick-up idlers 340 and 340'. As such, contact between the pick-up rubber 310 and the paper P is regulated.

Referring to FIGS. 2 and 3, as the driving device (not shown) rotates the pick-up shaft 330 in a direction indicated by arrow R, the pick-up housing 320 and the pick-up idlers 340 and 340' engaged with the pick-up shaft 330 are rotated by the rotating of the pick-up shaft 330. At this time, the pick-up rubber 310 wrapped around the pick-up housing 320 contacts the paper P to transfer the paper P to the development unit 240.

If the pick-up shaft 330 is engaged with the first shaft opening 321, only the first arcuate part 310*a* of the pick-up rubber 310 contacts the paper P. The second arcuate part 310*b* of the pick-up rubber 310 does not contact the paper P because the diameter of the rotation orbit of the second arcuate part 310*b* is smaller than that of the pick-up idlers 340 and 340'. As such, only the first arcuate part 310*a* of the pick-up rubber 310 is stained and abraded by paper powder, and finally used up. Meanwhile, the second arcuate part 310*b* of the pick-up rubber 310 maintains the initial status (that is, abrasion of the second arcuate part 310*b* is substantially prevented since the second arcuate part is not being used to pick up paper). As such, when the life span of the first arcuate part 310*a* of the pick-up rubber 310 is ended, the paper pick-up unit 300 is set for the second arcuate part 310*b* of the pick-up rubber 310 to contact the paper P.

Referring to FIG. 4A, when the life span of the first arcuate part 310*a* contacting the paper P of the pick-up rubber 310 is ended by abrasion and stain, a user moves the pick-up housing 320 in a direction indicated by arrow A with a certain force to unlock the pick-up shaft 330 engaged with the first shaft opening 321 from the first shaft opening 321. At this time, the pick-up shaft 330 engaged with the first shaft opening 321 moves past the lock protrusions 326. The elasticity and resiliency of the lock protrusions 326 causes the lock protrusions to return to their original position after the pick-up shaft 330 moves over the lock protrusions 326.

Figure 4B:
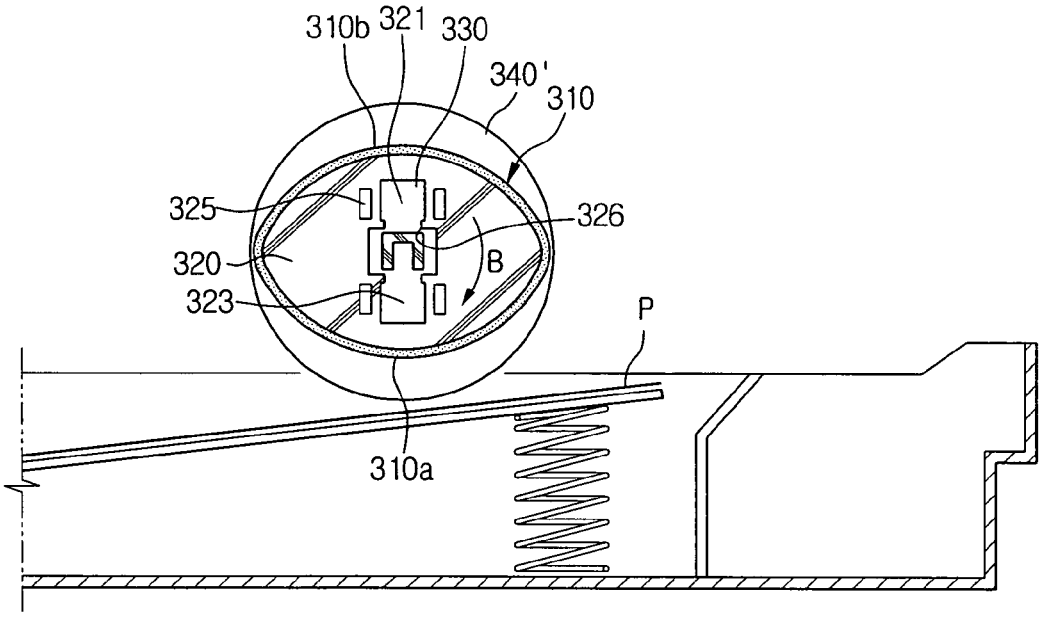

Referring to FIG. 4B, when the pick-up shaft 330 moves to the connecting opening 327, a user rotates the pick-up housing 320 by an angle of approximately 180 degrees in a direction indicated by arrow B for the second arcuate part 310*b* of the pick-up rubber to contact the paper P. As such, the position of the abraded first arcuate part 310*a* of the pick-up rubber 310 and the non-used second aruatec part 310*b* of the pick-up rubber 310 are changed to opposite positions with regard to the paper P.

Figure 4C:
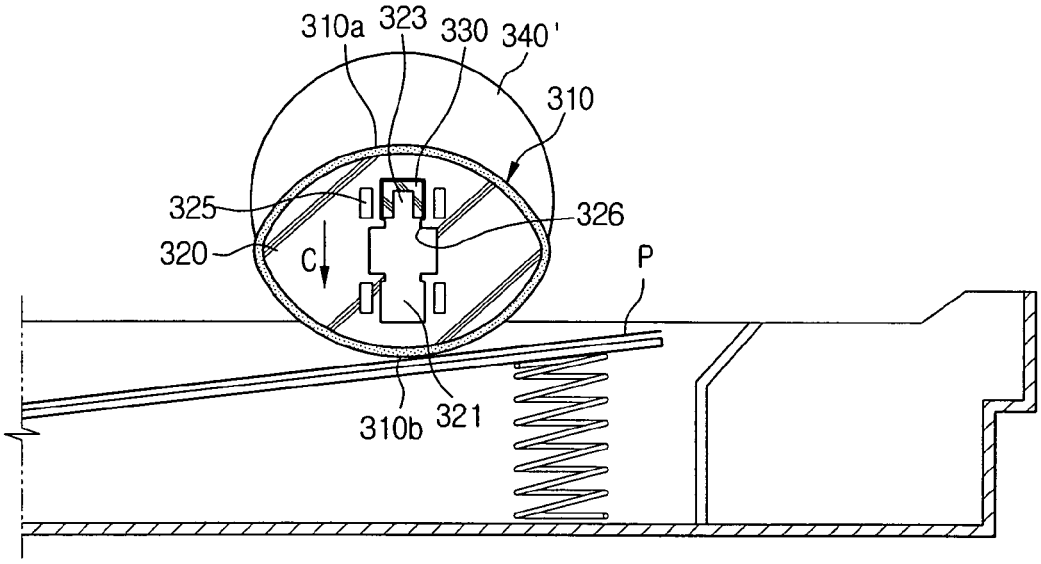

Referring to FIG. 4C, when the position of the second arcuate part 310*b* and the first arcuate part 310*a* of the pick-up rubber 310 is changed with respect to the paper P, a user moves the pick-up housing 320 in a direction indicated by arrow C to lock the pick-up shaft 330 to the second shaft opening 323.

In the above process, the pick-up shaft 330 moves over the lock protrusions 326. The lock protrusions 326 return to their original position due to their elasticity and resiliency after the pick-up shaft 330 moves over the lock protrusions 326. By the above method, the first arcuate part 310*a* is replaced with the second arcuate part 310*b* to contact and pick up the paper P.

Figure 5:
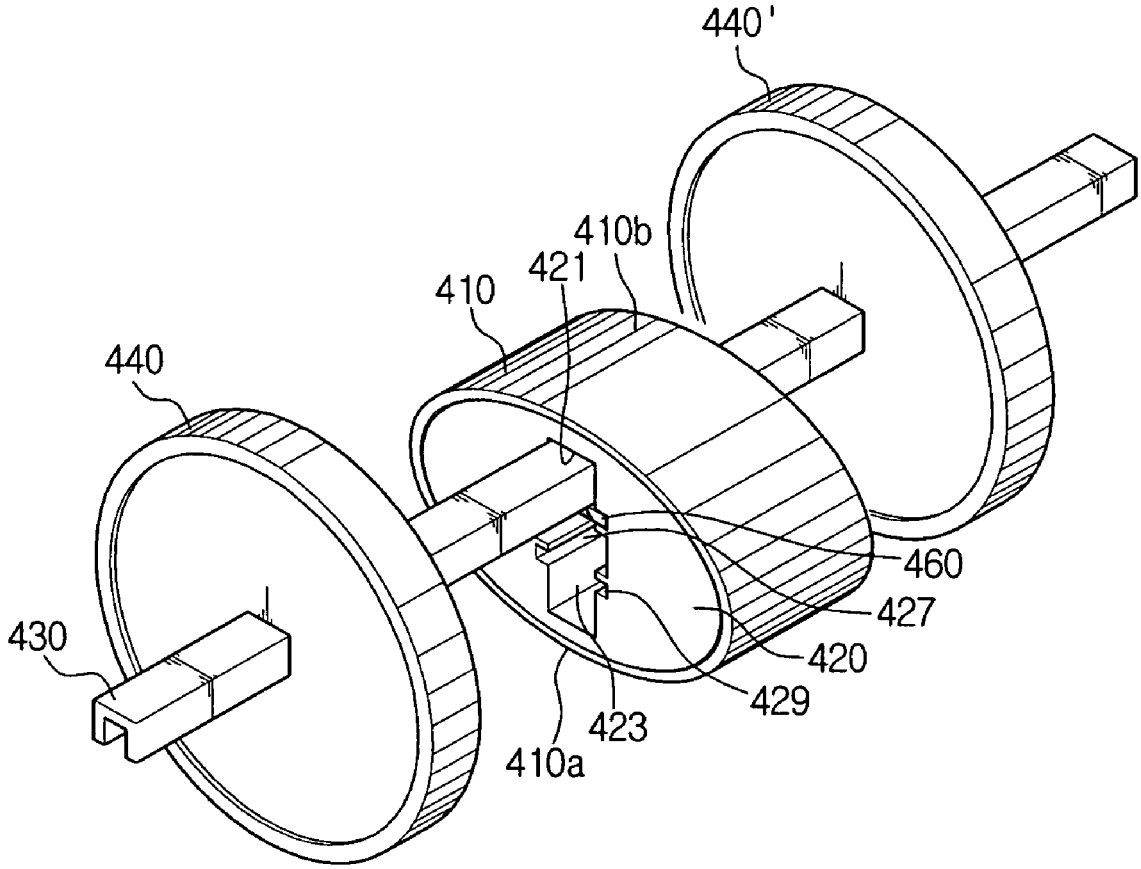
FIG. 5 is a perspective view of a paper pick-up unit according to another exemplary embodiment of the present invention.

Referring to FIG. 5, a key 460 may be used instead of the lock protrusions 326 (refer to FIG. 3), to lock or unlock a pick-up shaft 430 in a first shaft opening 421 and a second shaft opening 423 of a pick-up housing 420. Key grooves 429 are formed at a mouth part of the first shaft opening 421 and the second shaft opening 423 to mount the key 460 locking or unlocking the pick-up shaft 430.

Figure 6A:
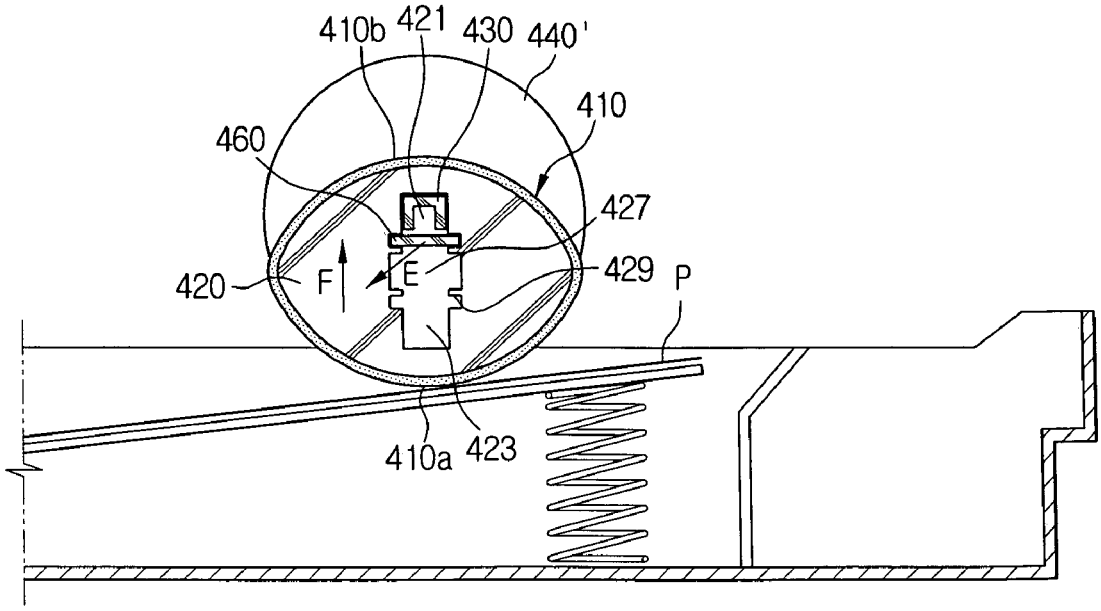
FIG. 6A, FIG. 6B and FIG. 6C are views showing each step of replacing a pick-up rubber of the paper pick-up unit of FIG. 5.

Referring to FIG. 6A, when the life span of the first arcuate part 410*a* of the pick-up rubber 410 is ended, a user removes the key 460 from the key grooves 429 in a direction indicated by arrow E and then moves the pick-up shaft 430 in a direction indicated by arrow F into the connecting opening 427 to unlock the pick-up shaft 430 from the first shaft opening 421.

Figure 6B:
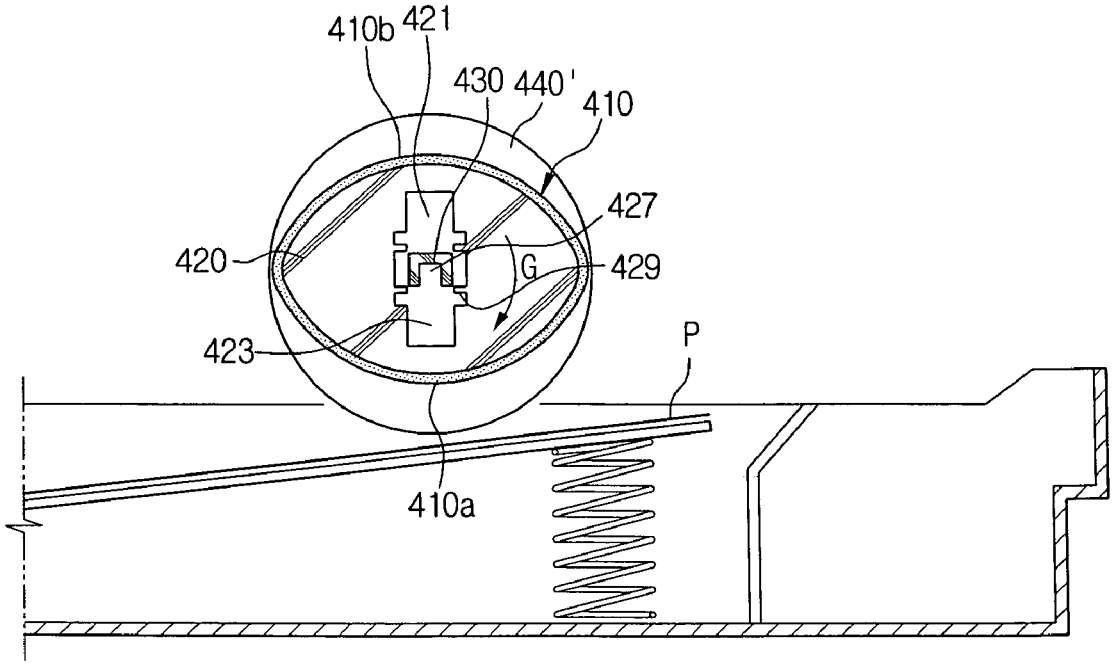

Referring to FIG. 6B, when the pick-up shaft 430 moves to the connecting opening 427, a user rotates the pick-up housing 420 in a direction indicated by arrow G by an angle of approximately 180 degrees for the second arcuate part 410*b* of the pick-up rubber 410 to contact the paper P. As such, the position of the abraded first arcuate part 410*a* and the second arcuate part 410*b* to maintain the initial status of the pick-up rubber 410 is changed in the opposite direction with regard to the paper P.

Figure 6C:
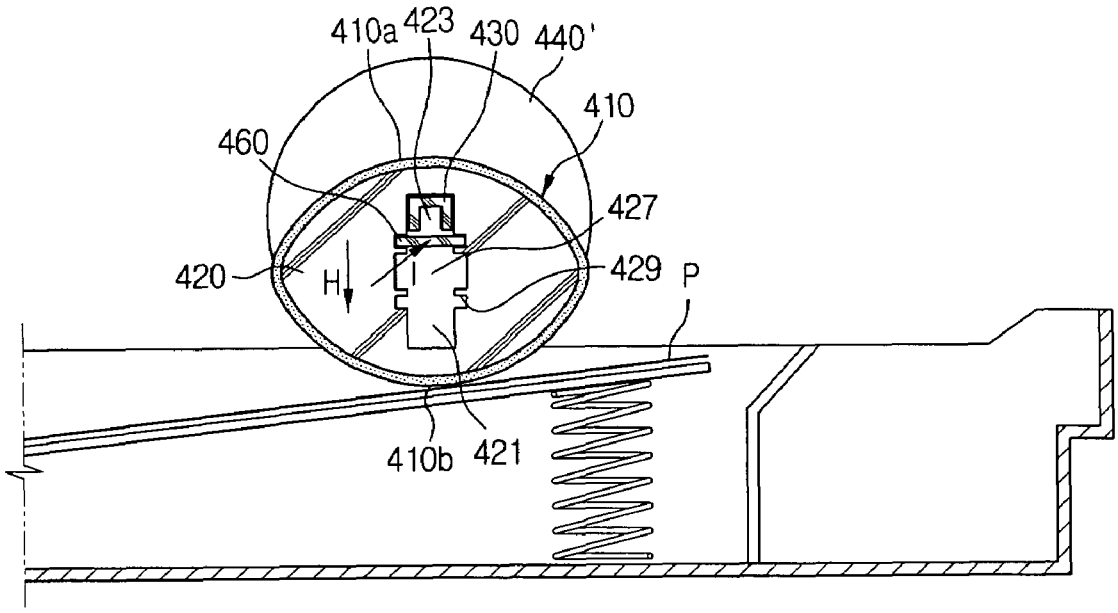

Referring to FIG. 6C, when the first arcuate part 410*a* is replaced with the second arcuate part 410*b*, a user moves the pick-up housing 420 in a direction indicated by arrow H and then inserts the key 460 into the key grooves 429 in a direction of arrow I to lock the pick-up shaft 430 into the second shaft opening 423. Accordingly, the second arcuate part 410*b* of the pick-up rubber 410 replacing the first arcuate part 410*a* now contacts the paper P to pick up the paper P.

As described above, both of the first arcuate part and the second arcuate part of an elliptical pick-up rubber may be used according to exemplary embodiments of the present invention. Therefore, the life span may be extended and the material costs may be reduced. Additionally, a user may easily replace the first arcuate part and the second arcuate part of the pick-up rubber such that the use convenience of an image forming apparatus may be highly improved.

The foregoing exemplary embodiments and advantages are merely exemplary and are not to be construed as limiting the present invention. The present teaching may be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. A paper pick-up unit of an image forming apparatus, composing:

an elliptical pick-up rubber having a first arcuate part and a second arcuate part, the first and second arcuate parts being symmetrical to each other and adapted to contact a paper;

a pick-up housing supporting the pick-up rubber attached around a circumference of the pick-up housing, a first shaft opening and a second shaft opening being disposed in the pick-up housing and that are formed opposite to each other and are eccentrically disposed with respect to a center of the pick-up housing; and a pick-up shaft engaging one of the first and second shaft openings of the pick-up housing, and being adapated to rotate such that the rotation of the pick-up shaft causes rotation of the pick-up housing.

2. The paper pick-up unit according to claim 1, wherein the pick-up shaft is engaged with the first shaft opening of the pick-up housing for the first arcuate part of the pick-up rubber to pick up a paper, or the pick-up shaft being engaged with the second shaft opening of the pick-up housing for the second arcuate part of the pick-up rubber to pick up a paper.

3. The paper pick-up unit according to claim 2, wherein a plurality of pick-up idlers are engaged with the pick-up shaft for maintaining regular contact between the first arcuate part or the second arcuate part and the paper.

4. The paper pick-up unit according to claim 3, wherein two of the pick-up idlers are engaged with the pick-up shaft substantially equidistantly from opposite sides of the pick-up housing.

5. The paper pick-up unit according to one of claim 4, wherein a connecting opening connects the first and second shaft openings to facilitate moving the pick-up shaft between the first and second shaft openings, and a lock means to lock the pick-up shaft in the first or second shaft opening.

6. The paper pick-up unit according to claim 5, wherein the pick-up shaft locking means includes locking protrusions that protrude inwardly from both ends of a mouth part of the first and second shaft openings, respectively.

7. The paper pick-up unit according to claim 5, wherein the pick-up shaft locking means includes key grooves formed at mouth parts of the first and second shaft openings and a key insertablea in the key grooves.

8. The paper pick-up unit according to claim 6, wherein the first shaft opening and the second shaft opening have a substantially quadrangular shape, and the pick-up shaft has a substantially flattened U-shaped cross section.

9. The paper pick-up unit according to claim 7, wherein the first shaft opening and the second shaft opening have a substantially quadrangular shape, and the pick-up shaft has a substantially flattened U-shaped cross section.

10. The paper pick-up unit according to claim 1, wherein the first and second arcuate parts of made of EPDM rubber.

11. The paper pick-up unit according to claim 3, wherein the idler rollers are substantially circular.

12. The paper pick-up unit according to claim 11, wherein a diameter of the idler rollers is larger than a distance from the center of the pick-up housing to the first or second arcuate parts along the minor axis of the pick-up housing.

13. An image forming apparatus, comprising:

an image forming unit having a photoconductive medium for forming an electrostatic latent image, and a development unit for developing the electrostatic latent image of the photoconductive medium;

a transmission unit having a paper transmission path connecting the image forming unit with a paper feeding cassette stacking a plurality of papers therein; and a paper pick-up unit for picking up a sheet of paper stacked in the paper feeding cassette to enter the paper to the paper transmission path, the paper pick-up unit including an elliptical pick-up rubber having a first arcuate part and a second arcuate part, the first and second arcuate parts being symmetrical to each other and adapted to contact a paper;

a pick-up housing supporting the pick-up rubber attached around a circumference of the pick-up housing, and having a first shaft opening and a second shaft opening formed opposite to each other in the pick-up housing and disposed eccentrically with respect to a center of the pick-up housing; and a pick-up shaft engaged with one of the first shaft opening and the second shaft opening of the pick-up housing, and being adapted to rotate such that the rotation of the pick-up shaft causes rotation of the pick-up housing.

14. The image forming apparatus according to claim 13, wherein the pick-up shaft is engaged with the first shaft opening of the pick-up housing for the first arcuate part of the pick-up rubber to pick up a paper, or the pick-up shaft is engaged with the second shaft opening of the pick-up housing for the second arcuate part of the pick-up rubber to pick up a paper.

15. The image forming apparatus according to claim 14, wherein a plurality of pick-up idlers are engaged with the pick-up shaft to maintain regular contact between the first arcuate part or the second arcuate part and the paper.

16. The image forming apparatus according to claim 15, wherein two of the pick-up idlers are engaged with the pick-up shaft equidistantly from opposite sides of the pick-up housing.

17. The image forming apparatus according to one of claims 16, wherein a connecting opening connects the first and second shaft openings to facilitate moving the pick-up shaft therebetween, and a locking means for locking the pick-up shaft in the first or second shaft opening.

18. The image forming apparatus according to claim 17, wherein the pick-up shaft locking means includes locking protrusions protruding inwardly from both ends of a mouth part of the first and second shaft openings, respectively.

19. The image forming apparatus according to claim 17, wherein the pick-up shaft locking means includes key grooves formed at a mouth part of the first and second shaft openings and a key insertable in the key grooves.

20. The image forming apparatus according to claim 12, wherein the idler rollers are substantially circular, and a diameter of the idler rollers is larger than a distance from the center of the pick-up housing to the first or second arcuate parts along the minor axis of the pick-up housing.

* * * * *